US008212645B2

(12) United States Patent
Navarro et al.

(10) Patent No.: US 8,212,645 B2
(45) Date of Patent: Jul. 3, 2012

(54) METHOD FOR PRODUCING A TRANSFORMER CORE AND A TRANSFORMER CORE

(75) Inventors: Martin Alsina Navarro, Jundiai (BR); Fritz Sorg, Stuttgart (DE)

(73) Assignee: Siemens Aktiengesellschaft, Munich (DE)

( * ) Notice: Subject to any disclaimer, the term of this patent is extended or adjusted under 35 U.S.C. 154(b) by 80 days.

(21) Appl. No.: 12/937,477

(22) PCT Filed: Apr. 10, 2008

(86) PCT No.: PCT/EP2008/003074

§ 371 (c)(1),
(2), (4) Date: Oct. 12, 2010

(87) PCT Pub. No.: WO2009/124574

PCT Pub. Date: Oct. 15, 2009

(65) Prior Publication Data

US 2011/0032069 A1 Feb. 10, 2011

(51) Int. Cl.
*H01F 7/06* (2006.01)
*H01F 27/24* (2006.01)

(52) U.S. Cl. ..... 336/216; 336/212; 336/217; 29/602.1

(58) Field of Classification Search ..... 336/212, 336/234, 178, 216, 217; 29/602.1
See application file for complete search history.

(56) References Cited

U.S. PATENT DOCUMENTS

| | | | | | |
|---|---|---|---|---|---|
| 2,300,964 | A | * | 11/1942 | Putman | 336/217 |
| 2,898,565 | A | * | 8/1959 | Fox et al. | 336/217 |
| 3,200,358 | A | * | 8/1965 | Neydli | 336/217 |
| 3,210,708 | A | * | 10/1965 | Franklin et al. | 336/217 |
| 3,598,020 | A | * | 8/1971 | Blok et al. | 91/416 |
| 3,743,991 | A | | 7/1973 | Grumpper et al. | |
| 3,895,336 | A | * | 7/1975 | Pitman | 336/217 |
| 4,200,854 | A | * | 4/1980 | DeLaurentis et al. | 336/217 |
| 4,827,237 | A | * | 5/1989 | Blackburn | 336/212 |
| 5,421,957 | A | * | 6/1995 | Carlson et al. | 216/58 |
| 5,959,523 | A | * | 9/1999 | Westberg | 336/234 |
| 6,060,978 | A | * | 5/2000 | Marquardt | 336/234 |
| 6,070,317 | A | | 6/2000 | Allen et al. | |

FOREIGN PATENT DOCUMENTS

| | | |
|---|---|---|
| CH | 257 843 | 10/1948 |
| CH | 257843 A | 10/1948 |
| DE | 1 489 773 | 9/1969 |
| DE | 1489773 A1 | 9/1969 |
| DE | 1 613 654 | 5/1970 |
| DE | 1613654 A1 | 5/1970 |

* cited by examiner

*Primary Examiner* — Anh Mai
(74) *Attorney, Agent, or Firm* — Laurence A. Greenberg; Werner H. Stemer; Ralph E. Locher

(57) ABSTRACT

A method for producing a transformer core with layers of core laminations includes forming at least one core lamination of at least two segmental laminations. An end region of a first segmental lamination has a straight crosscut edge. The straight crosscut edge of the first segmental lamination together with a corresponding straight crosscut edge of an end region of a second segmental lamination forms a form-locking straight abutting edge. The straight abutting edge is at an angle relative to the longitudinal direction of the end region of one of the segmental laminations of the first core lamination. Using core laminations having different angular orientations of the abutting edges, avoids magnetic losses such as those occurring when using conventional layering techniques. Simultaneously, an intermediate space created by conventional layering techniques between individual core lamination packs can be minimized, and thereby susceptibility to corrosion can likewise be reduced or completely avoided.

16 Claims, 6 Drawing Sheets

METHOD FOR PRODUCING A TRANSFORMER CORE AND A TRANSFORMER CORE

BACKGROUND OF THE INVENTION

Field of the Invention

The invention relates to a method for producing a transformer core, the transformer core being assembled layer by layer from core laminations and at least one core lamination being formed of at least two segmental laminations. An end region of the first segmental lamination has a straight crosscut edge, the straight crosscut edge of the first segmental lamination, together with a corresponding straight crosscut edge of an end region of the second segmental lamination, forming a form-locking straight abutting edge, and the straight abutting edge having an angle relative to the longitudinal direction of the end region of one of the segmental laminations of the first core lamination. Furthermore, the invention relates to a transformer core which is assembled layer by layer from core laminations, at least one core lamination being formed of two segmental laminations.

Transformer cores are usually assembled layer by layer from core laminations in high-voltage transformer construction. Using the core laminations creates a preferred magnetic direction along the laminations and reduces the eddy currents induced by the magnetic flux within the transformer core. The core laminations are usually assembled from segmental laminations, using especially the MI, EI, II or UI shapes of laminations. The assembled segmental laminations then form the respective core lamination which is then assembled layer by layer to form a transformer core.

The core laminations are layered in such a manner that the lamination ends (the so-called core points) are offset relative to one another in the lamination ends of the core segments. This can be done in the form of a so-called alternate layering or a so-called step-lap layering since, as a result, the effective cross section is reduced at the butt joints and thus has a positive effect on a reduction of the magnetic losses. Furthermore, a transformer layered in this manner is quieter during operation than a transformer core in which layers are directly on top of one another.

In the case of power transformers, crosscut shapes of the segmental laminations are preferably used which form abutting edges due to assembled form-locking crosscut edges, the abutting form-lockingly edges extending at an angle of 45° with reference to the longitudinal direction of the end area of one of the segmental laminations. Usually, points protrude at the lamination ends of the laminations of the outer limbs or of the yokes and recesses are located on the inside of the core window due to the staggering of the core laminations.

In this context, it is disadvantageous that these overlapping points and recesses form cavities which lead to moisture deposits and thus to corrosion especially in the case of dry transformers.

In the prior art, EP 1 655 747 A2, for example, describes a lamination cut for a layered core of a transformer. According to that invention, a first lamination part has an E-shaped basic shape which, together with a second I-shaped lamination part, forms a second yoke of the core lamination.

Furthermore, DE 101 32 719 A1 describes a method for producing electric core lamination assemblies. According to that invention, electric core laminations provided with a corrosion layer are cut to the respectively desired shape, the side faces and the crosscut edges of the cut core laminations first being coated with a corrosion protection layer and subsequently being assembled.

Furthermore, WO 2006/105024 A2 describes a transformer with a layered core and a cross-shaped limb. According to that invention, the transformer core is assembled from the respectively layered limb and yokes of the transformer core, the ends of the respective limbs and yokes being layered in a respectively corresponding manner.

Furthermore, WO 00/49628 describes a layered transformer core having an alternating sequence of S-shaped moldings.

BRIEF SUMMARY OF THE INVENTION

It is the object of the present invention to provide a rapidly and simply produced transformer core which has improved corrosion protection characteristics.

According to the invention, the object is achieved by the fact that a second core lamination consists of at least two segmental laminations of straight crosscut edges corresponding at the end regions, the assembled straight crosscut edges forming a second straight abutting edge and the second straight abutting edge of the second core lamination having an angle with respect to the longitudinal direction of the end region of one of the segmental laminations which differs from the angle of the first straight abutting edge of the first core lamination.

By using core laminations having an in each case different angular orientation of the abutting edge, magnetic losses as in the case of a conventional layering technique can be avoided, on the one hand. At the same time, the intermediate space between the individual core lamination stacks produced by the conventional layering techniques can be minimized and thus the susceptibility to corrosion can also be reduced or completely avoided.

Exclusively using segmental laminations with 0° or 90° crosscut edges for layering a transformer core is not advantageous since this would produce higher no-load losses of the transformer. Due to the layering of core laminations having differently oriented abutting edges, especially having an alternating orientation of between 45° and 90° or 0°, respectively, the core points causing corrosion can be omitted and, at the same time, lower no-load losses are produced within the transformer core in comparison with core laminations exclusively assembled at right angles.

It is considered as an advantage that the core laminations are layered with deviating angles $\Phi_1$, $\Phi_2$ of the abutting edges with reference to the longitudinal areas of the end region of the respectively assembled segmental laminations of the respective core laminations in an alternating sequence of the core laminations to form a transformer core. It is of advantage if the proportion of core laminations having an angle $\Phi_1$ of 45° of the abutting edge with reference to the proportion of the other core laminations having a deviating angle $\Phi_2$, for example of 90°, of the abutting edges assumes the highest proportion, three different lengths of lamination being used. Ideally, a sequence of three core laminations begins and ends with a core lamination which in each case has an angle $\Phi_1$ of 45° of the abutting edge and encloses a core lamination having an angle $\Phi_2$ of 90° of the abutting edge. An alternating sequence of in each case three core laminations as a sequential unit for three sequential passes would show the following layering sequence with reference to the respective angles $\Phi_1$ of 45° and $\Phi_2$ of 90° of the abutting edges: $\Phi_1, \Phi_2, \Phi_1, \Phi_1, \Phi_2, \Phi_1, \Phi_1, \Phi_2, \Phi_1$.

The respective abutting edges of the respective further core laminations are advantageously arranged next to one another with reference to the abutting edge of the first core lamination.

In an advantageous embodiment of the method, it is provided that the respective abutting edges of the respective further core laminations are offset with respect to one another with reference to the abutting edge of the first core lamination with respect to their position of the center point of the respective abutting edges in the longitudinal direction of the respective end region of one of the segmental laminations. Using known layerings such as the step-lap layering without using the core points used at the same time in the past leads to a reduction of the magnetic losses with, at the same time, only a slightly increased risk of corrosion in the recesses.

The angle $\Phi_1$ of the first abutting edge of the first core lamination is approximately 45 degrees with reference to the longitudinal direction of the end region of one of the core segments of the first core lamination, and the second core lamination has the abutting edge at an angle $\Phi_2$ of 0 degrees with reference to the longitudinal direction of the end region of one of the core laminations of the second core lamination, and the first and the second core lamination are arranged immediately next to one another. As an alternative, the angle $\Phi_1$ of the first abutting edge of the first core lamination is approximately 45 degrees with reference to the longitudinal direction of the end region of one of the core segments of the first core lamination, and the second core lamination has the abutting edge at an angle $\Phi_2$ of 90 degrees with reference to the longitudinal direction of the end region of one of the core laminations of the second core lamination, and the first and the second core lamination are arranged immediately next to one another.

In an advantageous embodiment of the method, the core laminations are arranged at an angle of the abutting edge of in each case $\Phi_1$=0 degrees, $\Phi_2$=45 degrees and $\Phi_3$=90 degrees next to one another and as assembled core laminations in an alternating sequence.

The first core lamination advantageously consists of at least three segmental core laminations, an abutting form-locking edge being formed at an angle $\Phi_l$ of 45 degrees between the first segmental core lamination and the second segmental core lamination, and the assembled first and second segmental core lamination having in a form-locking manner a straight abutting edge with the third segmental core lamination at an angle $\Phi_2$ of 0 degrees in the longitudinal direction of the end region of the third segmental core lamination. This combination of segmental laminations to form a core lamination is especially suitable as a configuration of the center yoke of the respective core lamination. The second core lamination consisting of two segmental core laminations forms a form-locking straight abutting edge at an angle $\Phi_1$ of 45 degrees with reference to the longitudinal direction of the end region of the second segmental core lamination. The segmental laminations for forming a center yoke of a core lamination can form different angles of the abutting edges assembled from the form-locking crosscut edges due to the respectively matching crosscut edges of the individual segmental laminations and thus provide an easily produced and loss-minimizing transformer core.

The object is also achieved, according to the invention, by a second core lamination which consists of at least two segmental laminations with straight crosscut edges corresponding at the end regions, and the assembled straight crosscut edges form a form-locking straight abutting edge, the abutting edge of the second core lamination having an angle $\Phi_2$ with reference to the longitudinal direction of the end region of one of the segmental laminations of the second core lamination which deviates from the angle $\Phi_1$ of the abutting edge of the first core lamination.

The angle $\Phi_1$ of the abutting edge of the first core lamination is advantageously approximately 45 degrees with reference to the longitudinal direction of the end region of one of the core segments of the first core lamination, and the second core lamination has a straight abutting edge at an angle of $\Phi_2$ of 0 or 90 degrees with reference to the longitudinal direction of the end region of one of the core segments of the second core lamination, and the second core lamination is arranged immediately next to the first core lamination.

It is considered an advantage that the first core lamination with an angle $\Phi_1$ of the abutting edge of approximately 0 degrees and a second core lamination with a straight abutting edge of the second core lamination with an angle $\Phi_2$ of approximately 90 degrees and a third core lamination with an angle $\Phi_3$ of the abutting edge of the third core lamination of approximately 45 degrees are arranged in an alternating sequence.

In an advantageous embodiment, the transformer core consists of the first core lamination having at least three segmental core laminations, a form-locking straight abutting edge being formed at an angle $\Phi_1$ of 45 degrees between the first segmental core lamination and the second segmental core lamination, and the assembled first and second segmental core lamination having in a form-locking manner a straight abutting edge with the third segmental core lamination at an angle $\Phi_2$ of 0 degrees in the longitudinal direction of the end region of the third segmental core lamination.

The segmental laminations preferably consist of cold-rolled grain-oriented iron laminations. The straight crosscut edges of the end region of the first and the second segmental lamination are advantageously stepped.

BRIEF DESCRIPTION OF THE SEVERAL VIEWS OF THE DRAWING

Further advantageous embodiments of the invention are described in the subclaims. The subject matter of the invention is explained in greater detail by means of selected exemplary embodiments, referring to the subsequent drawings, in which:

DESCRIPTION OF THE INVENTION

Figure 1:
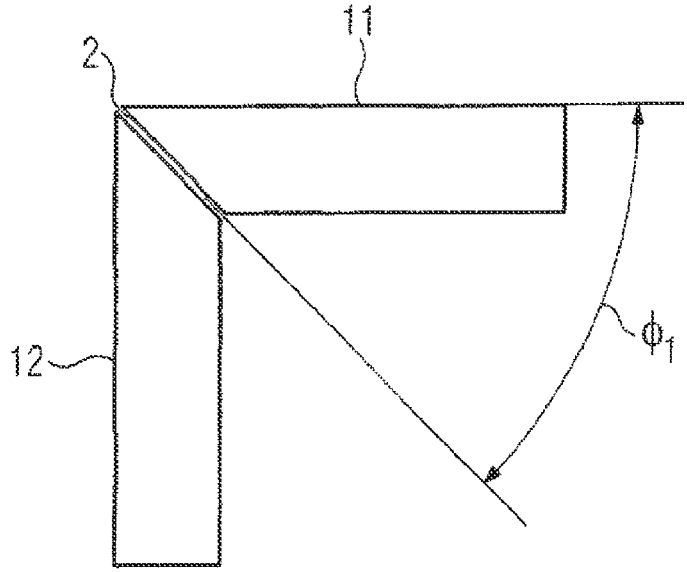
FIG. 1 shows a section of the core lamination as joining the upper yoke to the left limb at an angle $\Phi_1$ of 45 degrees of the abutting edge.

FIG. 1 shows a section of a core lamination 10, the section representing the upper left corner as joining the upper yoke to the left limb. A first segmental lamination 11 of the core lamination 10 forms a part of the upper yoke and a second segmental lamination 12 of the core lamination 10 forms the left limb of the transformer core 1 (not shown). The segmental laminations 11, 12 have in each case a crosscut edge which forms a form-lockingly straight abutting edge 2 of the core lamination 10. In the example shown in FIG. 1, the angle $\Phi_1$ is 45° with reference to the longitudinal direction of the first segmental lamination 11. This angle $\Phi_1$ is represented by corresponding dashed lines in FIG. 1. Since FIG. 1 only represents a section of the core lamination 10, corresponding straight abutting edges 2 can be arranged in each of the corners and as center limb of the transformer core 1. Furthermore, only two segmental laminations 11 and 12 can be formed in an L-shape so that the respective core lamination 10 only consists of two segmental laminations 11, 12.

Figure 2:
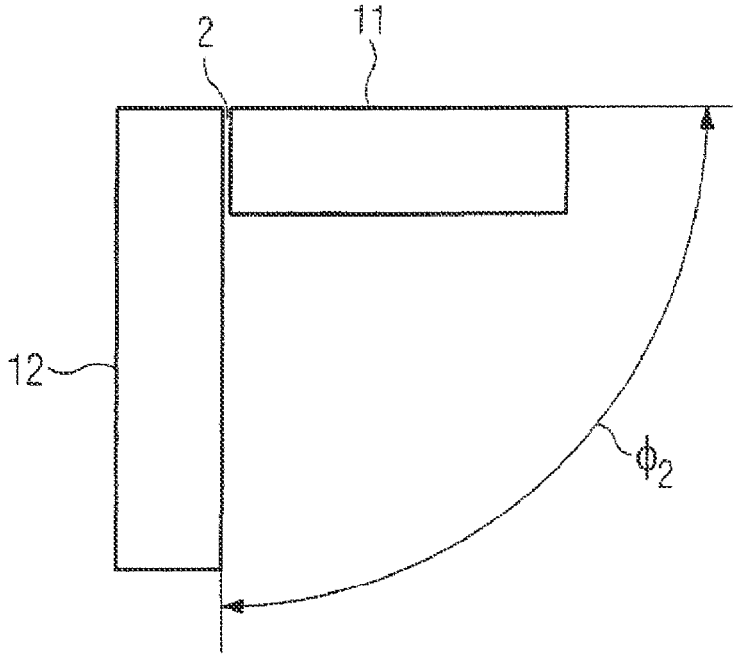
FIG. 2 shows a section of the core lamination as joining the upper yoke to the left limb at an angle $\Phi_2$ of 90 degrees of the abutting edge.
Figure 3:
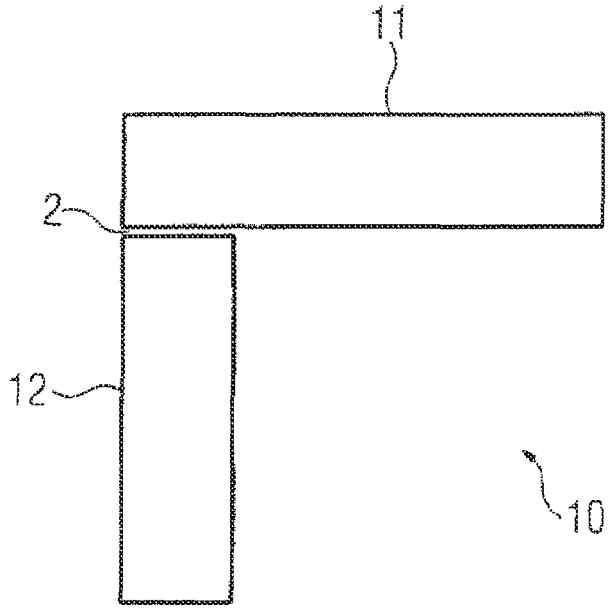
FIG. 3 shows a section of the core lamination as joining the upper yoke to the left limb at an angle $\Phi_1$ of 0 degrees of the abutting edge.

FIG. 2 again shows a section of the core lamination as joining the upper yoke to the left limb, the straight abutting edge 2 now extending at an angle $\Phi_2$ of 90° between the first segmental lamination 11 as part of the upper yoke and the second segmental lamination 12 as part of the left limb of the transformer core. In contrast, an angle $\Phi_1$ of the straight abutting edge 2 between the first segmental lamination 11 and the second segmental lamination 12 of the core lamination 10 of 0° is drawn in FIG. 3.

Figure 4:
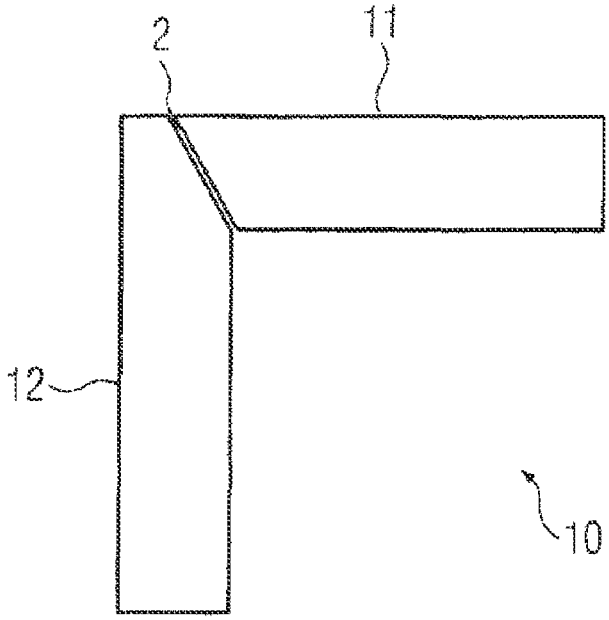
FIG. 4 shows a section of the core lamination as joining the upper yoke to the left limb at an angle $\Phi_1$ of 60 degrees of the abutting edge.
Figure 5:
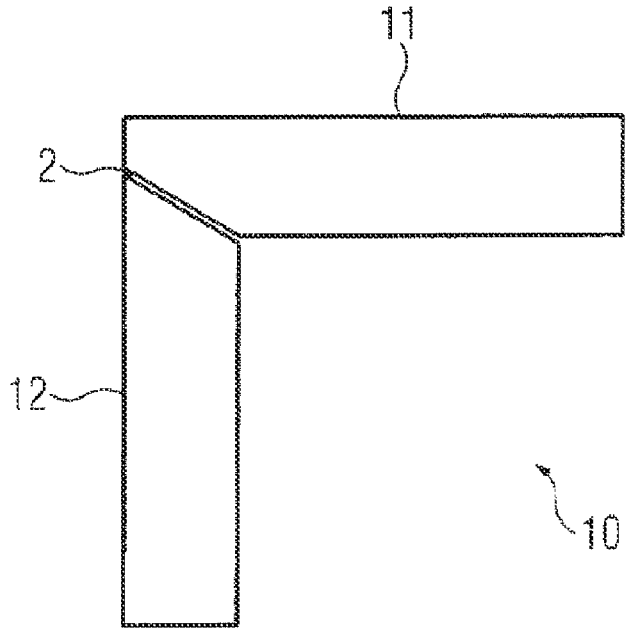
FIG. 5 shows a section of the core lamination as joining the upper yoke to the left limb at an angle $\Phi_1$ of 30 degrees of the abutting edge.

In FIG. 4, an angle of 60° is drawn between the first segmental lamination 11 and the second segmental lamination 12 of the core lamination 10 of the straight abutting edge 2; in FIG. 5, a straight abutting edge 2 is drawn at an angle of 30° between the first segmental lamination 11 and the second segmental lamination 12 of the core lamination 10.

Figure 6:
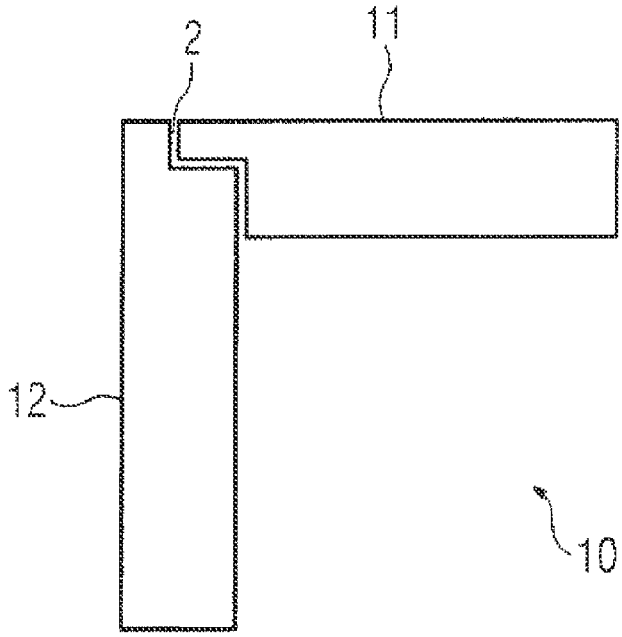
FIG. 6 shows a section of the core lamination as joining the upper yoke to the left limb with a stepped abutting edge.

The embodiment in FIG. 6 shows a stepped abutting edge between the first segmental lamination 11 and the second segmental lamination 12 of the core lamination 10.

Figure 7:
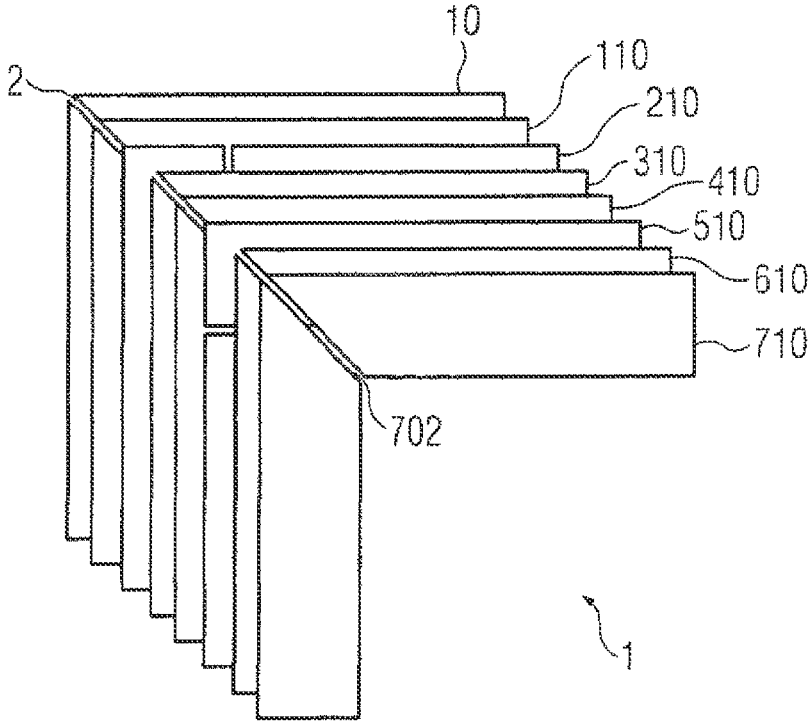
FIG. 7 shows a section of the transformer core with an alternating sequence of core laminations at a respective angle of the abutting edge of the first two core laminations $\Phi_1$ of 45 degrees and a respective angle of the abutting edge of a further core lamination $\Phi_2$ of 0 degrees or 90 degrees.

In FIG. 7, a section of the transformer core 1 is shown. The core laminations 10, 110, 210, 310, 410, 510, 610, 710 are represented in the upper left corner of the transformer core 1 so that only parts of the upper yoke and of the left limb of the transformer core 1 are visible. The core laminations 10, 110, 210, 310, 410, 510, 610, 710 are represented layered in an alternating sequence in such a manner that in each case one core lamination 10 has an abutting edge 2 at an angle $\Phi_1$ of 45° and an immediately adjoining core lamination 110 has an angle $\Phi_2$ of the straight abutting edge 102 of also 45°. This is followed by a core lamination 210 at an angle $\Phi_3$ with an abutting edge 210 at an angle of 90° or 0°. In the example shown in FIG. 7, the straight abutting edge 102 has an angle of $\Phi_3$=90°. This is followed again as an alternating sequence by a core lamination 310 and 410 at an angle of the straight abutting edge 302, 402 $\Phi_4$ and $\Phi_5$ of in each case 45°. This is followed by a sixth (the first one is 10 and not 110) core lamination 510 which encloses an angle of $\Phi_S$ of the straight abutting edge S02 between the first segmental lamination 11 (not explicitly drawn) and the second segmental lamination 12 (not explicitly drawn). This is followed by a core lamination 510 at an angle $\Phi_6$ of 0°. This is again followed by two core laminations 610, 710 at a respective angle $\Phi_{7,8}$, of the straight abutting edge 2 of 45°. In contrast to the layering method known in the prior art, in which the respective core laminations 10, 110, 210, 410, 510, 610, 710 in each case have a core point and are arranged slightly offset with respect to one another, the laminations in the present example can be assembled layer by layer without protruding points. By means of the present invention, no more core points are produced and thus also no hollow and intermediate spaces in which a fluid can collect and thus cause corrosion. Compared with a transformer core 1 layered exclusively with right-angled segmental laminations 11, 12, 13, the no-load losses of the transformer core 1 layered in accordance with the method according to the invention are reduced.

Figure 8:
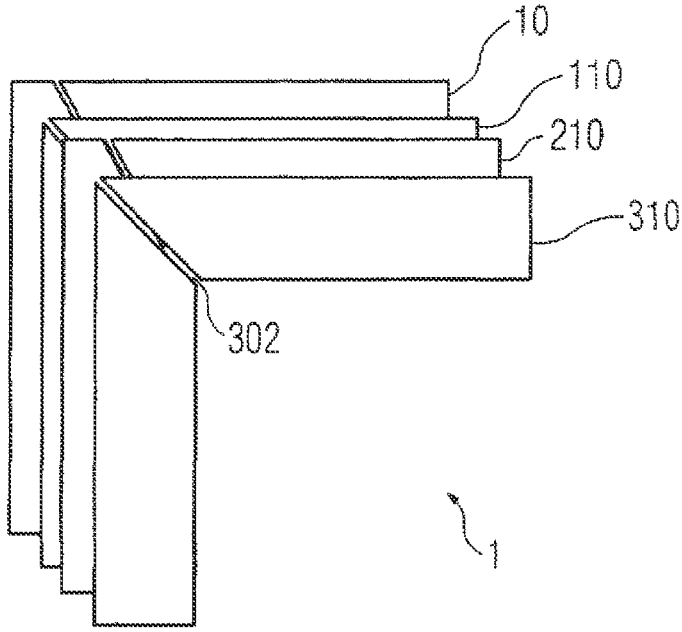
FIG. 8 shows a section of the transformer core with an alternating sequence of core laminations at a respective angle of the abutting edge $\Phi_1$ of 60 degrees, $\Phi_2$ of 45 degrees.

FIG. 8 shows a section of the upper left corner of a transformer core 1 as joint between the upper yoke and the left limb. In the example shown in FIG. 8, the core laminations 10, 210 alternate with an angle $\Phi_1$, $\Phi_3$ of 60° of the respective straight abutting edge 2, 202 in comparison with core laminations 110, 310 with an angle $\Phi_2$, $\Phi_4$ of the straight abutting edge 2, 102, 302 of 45°.

Figure 9:
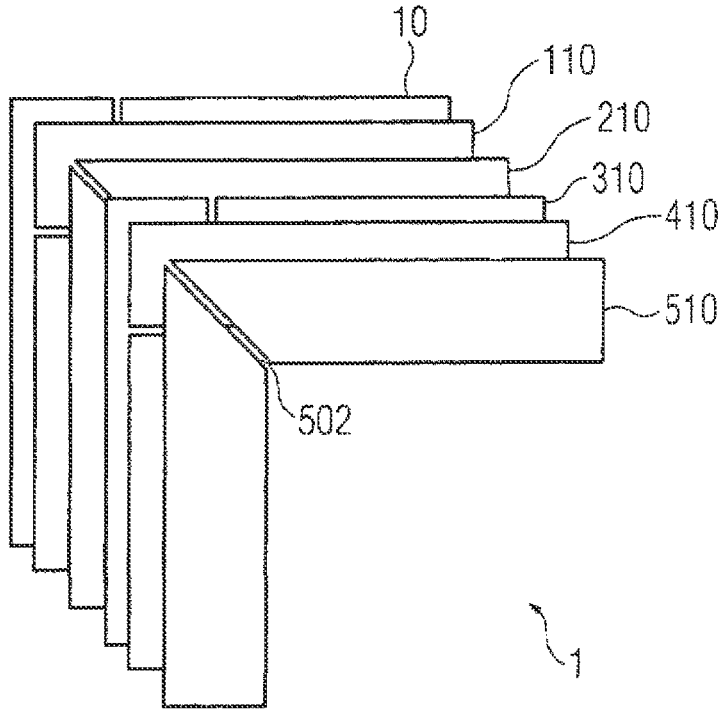
FIG. 9 shows a section of the transformer core with an alternating sequence of core laminations at a respective angle of the abutting edge $\Phi_1$ of 90 degrees, $\Phi_2$ of 0 degrees and $\Phi_1$ of 45 degrees.

In FIG. 9, a further combination of different angles of the straight abutting edge 2 with reference to a longitudinal direction of one of the segmental laminations 11 (not drawn) is shown. The upper left corner of a transformer core 1 is again shown as offset layering. In the example shown in FIG. 9, core laminations 10, 110, 210, 310, 410, 510 with an angle $\Phi_1$, $\Phi_4$ of 90° alternate with core laminations 10 and 310 of 0° with core laminations 110, 410 with an angle $\Phi_2$, $\Phi_5$ of 0° with core laminations 210, 510 with an angle $\Phi_3$, $\Phi_6$ of the straight abutting edge 2 of 45°.

For the purpose of better visualization, the examples shown in FIG. 7, FIG. 8 and FIG. 9 show the core laminations 10, 110, 210, 310, 410, 510, 610 in an offset manner. A transformer core 1 produced in accordance with the method according to the invention can therefore have either a cross section of the indicated round shape due to the ratios of lengths of the core laminations 10, 110, 210, 310, 410, 510, 610 or define a completely rectangular structure of the transformer core 1. The edges of the transformer core 1 therefore become almost level so that susceptibility to corrosion due to existing intermediate spaces would no longer exist.

Figure 10:
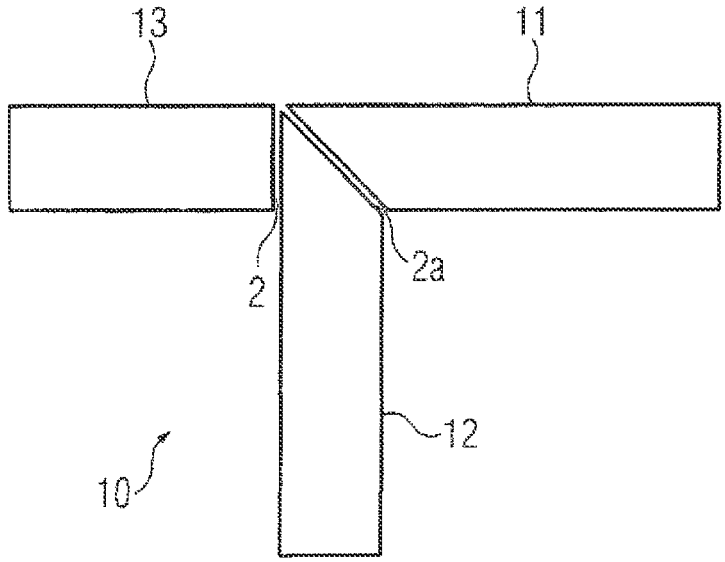
FIG. 10 shows a section of the core lamination as joining the upper yoke to the center limb at an angle $\Phi_1$ of 90 degrees of the first and $\Phi_2$ of 45 degrees of the second abutting edge.

FIG. 10 shows a section of the core lamination 10 as joining the upper yoke to the center limb of a three-phase transformer core. A first segmental lamination 11 of the core lamination 10 has a straight crosscut edge which has a first straight abutting edge 2*a* of the core lamination 10 form-locking with a corresponding crosscut edge of a second core lamination 12. The laminations of segments 11, 12 thus assembled partially define a crosscut edge which defines, with a corresponding crosscut edge of a further segmental lamination 13, a form-locking straight abutting edge at an angle of 90° with reference to the longitudinal direction of the first segmental lamination 11. The segmental laminations 11, 12, 13 thus assembled therefore have the two abutting edges 2, 2a.

According to the present invention, other angles of the straight abutting edges 2, 2*a* are easily applicable.

Figure 11:
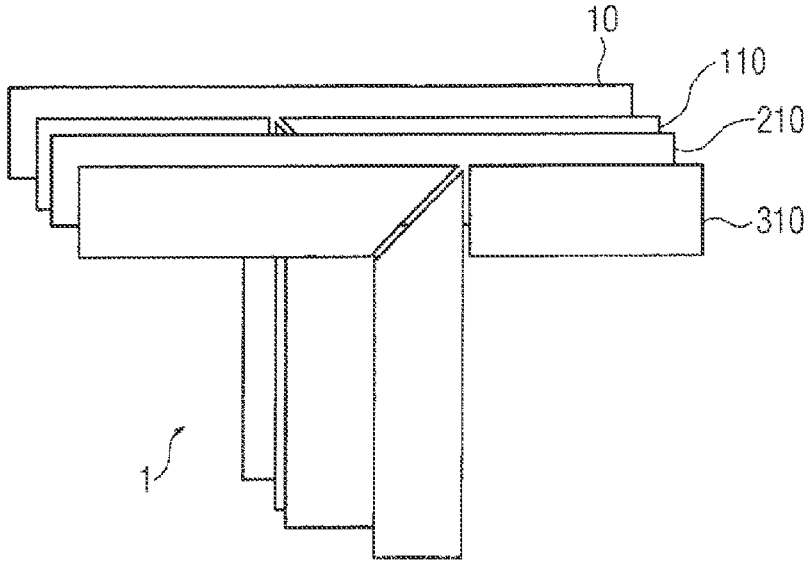
FIG. 11 shows a section of the transformer core with an alternating sequence of core laminations at a respective angle of the first abutting edge $\Phi_1$ of 45 degrees, $\Phi_2$ of 90 degrees of the first core lamination and a respective angle of the first abutting edge $\Phi_1$ of 90 degrees of the second core lamination.

FIG. 11 shows a section of a transformer core 1 according to the invention in which the most varied core laminations 10, 110, 210, 310 are combined. The section of the transformer core 1 shown in FIG. 11 again shows the cross-shaped part of the upper yoke joined to the center limb of a multiphase transformer core 1. In this arrangement, a first design of a core lamination 10 of a continuous first segmental lamination 11 (not drawn) as end-to-end upper yoke is combined with a center limb, adjoining at right angles, as second core lamination 12 (also not shown) in an alternating sequence of the core laminations 10, 110, 210, 310. The first core lamination 10 designed in this manner is layered, as part of the method according to the invention, next to a second core lamination 110, the second core lamination 110 having segmental laminations 11, 12, 13 (not drawn) which have two abutting edges 2, 2*a* at an angle $\Phi_1$ of 45° and $\Phi_2$ of 90°. The fourth core lamination 310 is mirror-inverted with respect to the design with the second core lamination 110.

Figure 12:
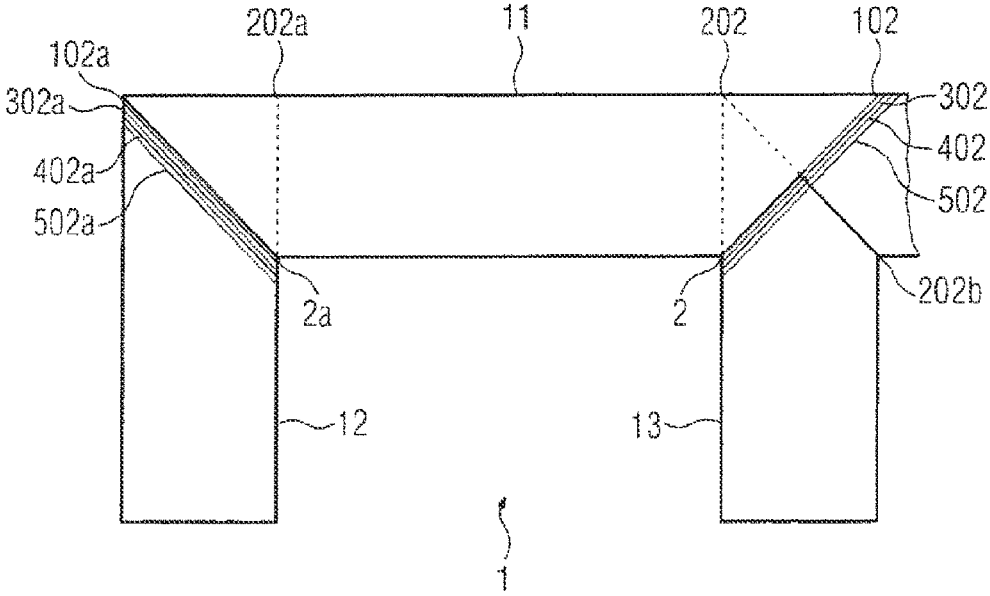
FIG. 12 shows a section of the transformer core with respect to the left limb and the center limb to the upper yoke with an alternating sequence of core laminations.

In the representation of FIG. 12, the upper area of a transformer core 1 is visible with partially center limb, left outer limb and upper yoke. In FIG. 12, the layering of the transformer core 1 with respect to the different core laminations 10, 110, 210, 310, 410, 510 is shown. In the example shown in FIG. 12, the first core lamination 10 has at least three segmental laminations 11, 12, 13, the abutting edge 2, 2*a* of the upper yoke having two angles of ±45° and the straight abutting edge 2*a* between the first and second segmental lamination 11, 12 having an angle of 45°.

In the example shown, the next core lamination 110 (not shown) has a crosscut edge 102 extending at an angle of 45° between the fist segmental lamination 11 and the third segmental lamination 13 of the joint between the upper yoke and the center limb. Furthermore, the left limb is form-lockingly assembled as second segmental lamination 12 with the first segmental lamination 11 as upper yoke via an angle of 45° of the abutting edge 202. The abutting edges 202, 202*a* and 202*b* of the third core lamination 210 (not drawn) extend at an angle of in each case 90° and 45°, respectively. In this case, the segmental laminations 11, 12 between the upper yoke and the left limb are joined via a 90° abutting edge 202*a*. A part of the upper yoke is form-lockingly assembled as first segmental lamination 11 at an angle of 90° with the third segmental lamination 13 as part of the center limb, also at an angle of 90°. The third segmental lamination 13 additionally has a crosscut edge at an angle of 45° which forms a form-locking third abutting edge 202*b* with a corresponding crosscut edge of a fourth segmental lamination (not drawn).

The further abutting edges in the example shown, 302, 302*a*, 402, 402*a*, 502 and 502*a* of the fourth to sixth core laminations 310, 410, 510 (not drawn) extend at an angle of in each case 45°. Furthermore, a minimum offset of the identically extending abutting edges 102, 302, 402, 502 and 102, 302*a*, 402*a* and 502*a* is visible in the representation of FIG. 12 so that the method according to the invention can be used in the coating of conventional transformers and the interfering influences of corresponding core points is prevented.

LIST OF REFERENCE DESIGNATIONS

1 Transformer core
2, 2*a* Abutting edge of the first core lamination
10 First core lamination
11, 12, 13 Segmental lamination of a core lamination
102, 102*a* Abutting edges of the second core lamination
110 Second core lamination
202, 202*a*, 202*b* Abutting edges of the third core lamination
210 Third core lamination
302, 302*a* Abutting edges of the fourth core lamination
310 Fourth core lamination
402, 402*a* Abutting edges of the fifth core lamination
410 Fifth core lamination
502, 502*a* Abutting edges of the sixth core lamination
510 Sixth core lamination
602, 602*a* Abutting edges of the seventh core lamination
610 Seventh core lamination
702, 702*a* Abutting edges of the eighth core lamination
710 Eighth core lamination

The invention claimed is:

1. A transformer core, comprising:

first and second layered core laminations each having at least first and second segmental laminations, said segmental laminations each having a respective end region with a respective corresponding straight crosscut edge and a longitudinal direction;

said straight crosscut edges of said end regions of said first and second segmental laminations together forming a form-locking straight abutting edge in each respective one of said core laminations;

said abutting edge of said first core lamination forming a first angle with said longitudinal direction of said end region of one of said segmental laminations of said first core lamination;

said abutting edge of said second core lamination forming a second angle with said longitudinal direction of said end region of one of said segmental laminations of said second core lamination; and said second angle deviating from said first angle.

2. The transformer core according to claim 1, wherein:

said first angle of said abutting edge of said first core lamination is approximately 45 degrees relative to said longitudinal direction of said end region of one of said segmental laminations of said first core lamination;

said second angle of said abutting edge of said second core lamination is 0 or 90 degrees relative to said longitudinal direction of said end region of one of said segmental laminations of said second core lamination; and said second core lamination is immediately next to said first core lamination.

3. The transformer core according to claim 1, which further comprises:

a third core lamination having at least first and second segmental laminations each having a respective end region with a respective corresponding straight crosscut edge and a longitudinal direction, said straight crosscut edges of said end regions of said first and second segmental laminations together forming a form-locking straight abutting edge in said third core lamination forming a third angle with said longitudinal direction of said end region of one of said segmental laminations of said third core lamination;

said first angle of said abutting edge of said first core lamination being approximately 0 degrees;

said second angle of said abutting edge of said second core lamination being approximately 90 degrees;

said third angle of said abutting edge of said third core lamination being approximately 45 degrees; and said first, second and third core laminations being disposed in an alternating sequence.

4. The transformer core according to claim 1, wherein:

said first core lamination has at least first, second and third segmental laminations;

said first segmental lamination and said second segmental lamination form a form-locking straight abutting edge therebetween at said first angle of 45 degrees; and said first and second segmental laminations together form a form-locking straight abutting edge with said third segmental lamination at said second angle of 0 degrees in said longitudinal direction of said end region of said third segmental lamination.

5. The transformer core according to claim 1, wherein said segmental laminations are formed of cold-rolled grain-oriented iron laminations.

6. The transformer core according to claim 1, wherein said straight crosscut edges of said end region of said first and second segmental laminations are stepped.

7. A method for producing a transformer core, the method comprising the following steps:

assembling the transformer core layer by layer from at least first and second core laminations;

forming each of the first and second core laminations with at least first and second segmental laminations having end regions with longitudinal directions;

providing the end region of the first segmental lamination with a straight crosscut edge and providing the corresponding end region of the second segmental lamination with a straight crosscut edge in each of the first and second core laminations;

forming a form-locking first straight abutting edge from the straight crosscut edges of the end regions of the first and second segmental laminations of the first core lamination;

forming a first angle between the first abutting edge and the longitudinal direction of the end region of one of the segmental laminations of the first core lamination;

forming a form-locking second straight abutting edge from the straight crosscut edges of the end regions of the first and second segmental laminations of the second core lamination;

forming a second angle between the second abutting edge and the longitudinal direction of the end region of one of the segmental laminations of the second core lamination; and providing a difference between the second angle of the second abutting edge of the second core lamination and the first angle of the first abutting edge of the first core lamination.

8. The transformer core according to claim 1, wherein the transformer core is produced by the method of claim 7.

9. The method according to claim 7, which further comprises layering the core laminations with deviating angles of the abutting edges with reference to longitudinal areas of the end region of the respectively assembled segmental laminations of the respective core laminations in an alternating sequence of the core laminations to form a transformer core.

10. The method according to claim 7, which further comprises placing respective abutting edges of respective further core laminations next to one another with reference to the abutting edge of the first core lamination.

11. The method according to claim 7, which further comprises offsetting respective abutting edges of respective further core laminations with respect to one another with reference to the abutting edge of the first core lamination with respect to their position of a center point of the respective abutting edges in the longitudinal direction of the respective end region of one of the segmental laminations.

12. The method according to claim 7, which further comprises:

providing the first angle of the first abutting edge of the first core lamination at approximately 45 degrees with reference to the longitudinal direction of the end region of one of the segmental laminations of the first core lamination;

providing the second core lamination with the abutting edge at the second angle of 0 degrees with reference to the longitudinal direction of the end region of one of the core laminations of the second core lamination; and placing the first and second core laminations immediately next to one another.

13. The method according to claim 7, which further comprises:

providing the first angle of the first abutting edge of the first core lamination at approximately 45 degrees with reference to the longitudinal direction of the end region of one of the segmental laminations of the first core lamination;

providing the second core lamination with the abutting edge at the second angle of 90 degrees with reference to the longitudinal direction of the end region of one of the core laminations of the second core lamination; and placing the first and second core laminations immediately next to one another.

14. The method according to claim 7, which further comprises placing the core laminations at a respective first angle of 0 degrees, second angle of 45 degrees and third angle of 90 degrees of the abutting edge next to one another and as assembled core laminations in an alternating sequence.

15. The method according to claim 7, which further comprises:

forming the first core lamination with at least three segmental laminations having an abutting edge form-locking at the first angle of 45 degrees between the first segmental lamination and the second segmental lamination; and providing the assembled first and second segmental laminations in a form-locking manner with a straight abutting edge having a third segmental lamination at the second angle of 0 degrees in the longitudinal direction of the end region of the third segmental lamination.

16. The method according to claim 15, which further comprises providing the second core lamination with two segmental laminations forming a form-locking straight abutting edge at a first angle of 45 degrees with reference to the longitudinal direction of the end region of the second core lamination.

* * * * *